US009095025B2

(12) United States Patent
Fujita et al.

(10) Patent No.: US 9,095,025 B2
(45) Date of Patent: Jul. 28, 2015

(54) DRIVE CIRCUIT, ILLUMINATION LIGHT SOURCE, AND LIGHTING APPARATUS

(71) Applicant: Panasonic Corporation, Osaka (JP)

(72) Inventors: Hiroshi Fujita, Osaka (JP); Atsushi Utsubo, Osaka (JP); Kazuhiko Itoh, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/161,409

(22) Filed: Jan. 22, 2014

(65) Prior Publication Data

US 2014/0217897 A1 Aug. 7, 2014

(30) Foreign Application Priority Data

Feb. 5, 2013 (JP) ..... 2013-020841

(51) Int. Cl.
*H05B 37/02* (2006.01)
*H05B 33/08* (2006.01)

(52) U.S. Cl.
CPC ..... *H05B 33/0815* (2013.01); *H05B 33/0803* (2013.01)

(58) Field of Classification Search
USPC ..... 315/291, 200 R, 118, 224; 363/24.1
See application file for complete search history.

(56) References Cited

U.S. PATENT DOCUMENTS

| | | | | |
|---|---|---|---|---|
| 8,237,374 | B2 | 8/2012 | Kitamura et al. | |
| 2005/0225257 | A1* | 10/2005 | Green | 315/209 R |
| 2007/0040516 | A1* | 2/2007 | Chen | 315/291 |
| 2009/0200965 | A1* | 8/2009 | King | 315/307 |
| 2010/0052566 | A1* | 3/2010 | Kitamura et al. | 315/291 |
| 2011/0090604 | A1* | 4/2011 | Butler | 361/18 |
| 2012/0153854 | A1* | 6/2012 | Setomoto et al. | 315/200 R |
| 2012/0194090 | A1* | 8/2012 | Esaki et al. | 315/200 R |
| 2012/0206064 | A1* | 8/2012 | Archenhold | 315/297 |
| 2012/0235636 | A1* | 9/2012 | Partovi | 320/108 |
| 2012/0248211 | A1* | 10/2012 | Warren et al. | 236/1 C |
| 2012/0268033 | A1 | 10/2012 | Kitamura et al. | |
| 2013/0300204 | A1* | 11/2013 | Partovi | 307/104 |

FOREIGN PATENT DOCUMENTS

| | | | |
|---|---|---|---|
| JP | 2010-086943 | A | 4/2010 |
| WO | WO 2012/011288 | A1 | 1/2012 |
| WO | WO 2012/095936 | A1 | 7/2012 |

* cited by examiner

*Primary Examiner* — Thuy Vinh Tran
*Assistant Examiner* — Syed M Kaiser
(74) *Attorney, Agent, or Firm* — Renner, Otto, Boisselle & Sklar, LLP

(57) ABSTRACT

A drive circuit is a drive circuit for turning on an LED and includes a self-excited inverter supplying power to the LED, wherein the self-excited inverter includes thermistors, and supplies, depending on temperature dependency of the thermistors, the first power value to the LED when a temperature is the first temperature, and the second power value to the LED when a temperature is the second temperature higher than the first temperature, and the second power value is smaller than the third power value that a circuit which is not provided with the thermistors and supplies the first power value to the LED when the temperature is a first temperature supplies to the LED when a temperature is the second temperature.

6 Claims, 4 Drawing Sheets

DRIVE CIRCUIT, ILLUMINATION LIGHT SOURCE, AND LIGHTING APPARATUS

CROSS REFERENCE TO RELATED APPLICATION

The present application is based on and claims priority of Japanese Patent Application No. 2013-020841 filed on Feb. 5, 2013. The entire disclosure of the above-identified application, including the specification, drawings and claims is incorporated herein by reference in its entirety.

FIELD

The present invention relates to a drive circuit for turning on a light-emitting element, and an illumination light source and a lighting apparatus which include the drive circuit.

BACKGROUND

Because of their high efficiency and long life, light emitting diodes (LEDs) are expected to be used as the next-generation of light sources in various products, for example, well-known conventional lighting apparatuses such as a fluorescent light and an incandescent light bulb. Thus, research and development for LED-based lighting light sources are being undertaken. At the same time, development for drive circuits for driving LEDs is also being undertaken (see, Patent Literature (PTL) 1 for example).

CITATION LIST

Patent Literature

Patent Literature 1: Japanese Unexamined Patent Application Publication No. 2010-86943

SUMMARY

Technical Problem

However, such an LED-based lighting apparatus is expected to reduce a rise in temperature caused by heat generation of the LED. The rise in temperature leads to a deterioration of the lighting apparatus, thereby shortening the life of the lighting apparatus.

Therefore, the present invention has an object to provide a drive circuit which can reduce a rise in temperature.

Solution to Problem

In order to achieve the above mentioned goal, a drive circuit according to an aspect of the present invention is a drive circuit for turning on a light-emitting element, and the drive circuit includes a self-excited inverter which supplies power to the light-emitting element, wherein the self-excited inverter includes a thermistor, and depending on temperature dependency of the thermistor, supplies a first power value to the light-emitting element when a temperature is a first temperature, and a second power value to the light-emitting element when a temperature is a second temperature higher than the first temperature, and the second power value is smaller than a third power value to be supplied to the light-emitting element by a circuit when a temperature is the second temperature, the circuit not being provided with the thermistor and supplying the first power value to the light-emitting element when a temperature is the first temperature.

For example, the self-excited inverter may be a half-bridge self-excited inverter.

For example, the thermistor may have a positive temperature characteristic.

For example, the self-excited inverter may include: a first switching element and a second switching element which are connected in series and alternately perform switching operations; a first resistor connected to a base of the first switching element; and a second resistor connected to a base of the second switching element, wherein the thermistor may include a first thermistor and a second thermistor, the first thermistor may be connected in parallel to the first resistor, and the second thermistor may be connected in parallel to the second resistor.

For example, the self-excited inverter may include: a first switching element and a second switching element which are connected in series and alternately perform switching operations; a first resistor connected to an emitter of the first switching element; and a second resistor connected to an emitter of the second switching element, wherein the thermistor may include a first thermistor and a second thermistor, the first thermistor may be connected in parallel to the first resistor, and the second thermistor may be connected in parallel to the second resistor.

Moreover, an illumination light source according to an aspect of the present invention includes: the drive circuit; and a light-emitting element which is turned on by the drive circuit.

Moreover, a lighting apparatus according to an aspect of the present invention includes: the drive circuit; and a light-emitting element which is turned on by the drive circuit.

Advantageous Effects

The present invention can provide a drive circuit which can reduce a rise in temperature.

BRIEF DESCRIPTION OF DRAWINGS

These and other objects, advantages and features of the invention will become apparent from the following description thereof taken in conjunction with the accompanying drawings that illustrate a specific embodiment of the present invention.

FIG. 1 is a circuit configuration of a drive circuit according to an embodiment.

FIG. 2 is a circuit configuration of a drive circuit according to a modification of the embodiment.

FIG. 3 is an outer perspective view of a light bulb-shaped lamp according to the embodiment.

FIG. 4 is a schematic cross-sectional view of a lighting apparatus according to the embodiment.

DESCRIPTION OF EMBODIMENT

The following will describe an embodiment with reference to the drawings.

It should be noted that an embodiment described below is a comprehensive or specific example. The numerical values, shapes, materials, constituent elements, the arrangement position and connection form of the constituent elements, steps, and the processing order of the steps etc. shown in the following embodiment are mere examples, and thus do not limit the present invention. Thus, among the constituent elements in the following embodiment, constituent elements not recited in any of the independent claims indicating the most generic concept of the present invention are described as arbitrary constituent elements.

(Circuit Configuration)

Figure 1:
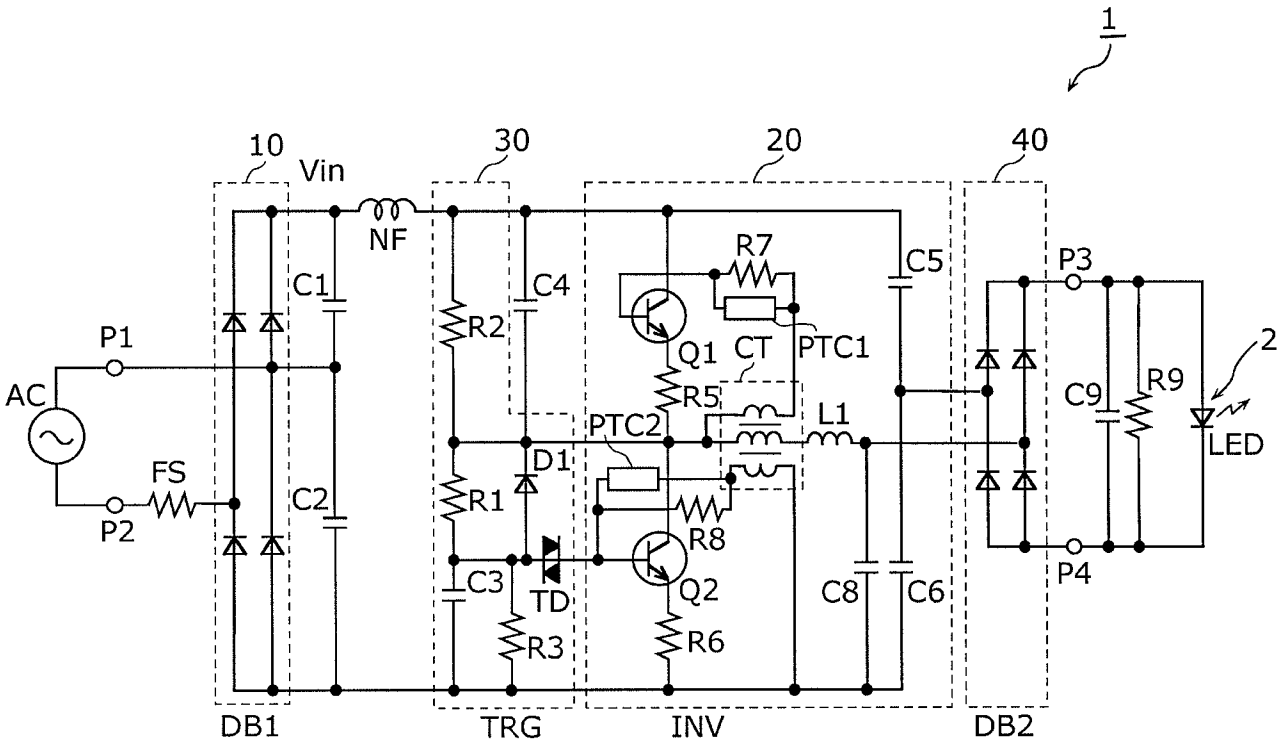
[FIG. 1]

First, a circuit configuration of a drive circuit 1 according to the embodiment is described with reference to FIG. 1. FIG. 1 is a diagram showing a circuit configuration of the drive circuit 1 according to the embodiment.

As shown in FIG. 1, the drive circuit 1 according to the embodiment is an LED drive circuit for turning on an LED 2 (LED lighting circuit), and includes a first rectifier circuit 10, an inverter 20, an inverter control circuit 30, and a second rectifier circuit 40.

The drive circuit 1 has input terminals P1 and P2 for receiving an AC voltage. The input terminals P1 and P2 are connected to an AC power source, and also connected to respective input ends of the first rectifier circuit 10. For example, the input terminals P1 and P2 of the drive circuit 1 are connected to a utility AC power source through a wall switch. It should be noted that the utility AC power source refers to a 100V AC power source, i.e. a household AC power source. Furthermore, the input terminals P1 and P2 refer to a base of a light bulb-shaped LED lamp attached to a socket to which AC power source is supplied, for example.

The drive circuit 1 also has output terminals P3 and P4 for providing a DC voltage. The output terminals P3 and P4 are connected to the LED 2, and also connected to the output ends of the second rectifier circuit 40. The high potential output terminal P3 is connected to an anode of the LED 2, and the low potential output terminal P4 is connected to a cathode of the LED 2. The LED 2 emits light using the DC voltage provided from the drive circuit 1. It should be noted that in the embodiment the LED 2 is connected in parallel to a capacitor C9 and a resistor R9.

The following will describe in detail each of the constituent elements of the drive circuit 1 according to the embodiment.

First, the first rectifier circuit 10 is described. The first rectifier circuit 10 (DB1) is a full-wave bridge rectifier circuit comprising four diodes. Two terminals on the input side of the first rectifier circuit 10 are connected to the AC power source via respective input terminals P1 and P2, and two terminals on the output side are connected to a smoothing capacitor C1 and a smoothing capacitor C2, for example. It should be noted that the smoothing capacitors C1 and C2 are provided to stabilize an output voltage of the first rectifier circuit 10, and are an electrolytic capacitor for example. In the embodiment, the two smoothing capacitor C1 and C2 are used as an example, but a single smoothing capacitor may be connected between two terminals of the output side of the first rectifier circuit 10.

A wiring connecting the AC power source and the first rectifier circuit 10 has a current fuse element FS (15 ohms) connected in series therebetween. Furthermore, another wiring connecting the inverter control circuit 30 and a negative voltage output terminal of the first rectifier circuit 10 has a noise filter NF (1 mH) for removing switching noise disposed therebetween.

The first rectifier circuit 10 receives an AC voltage (for example, 50 or 60 Hz) from the utility AC power source through a wall switch for example, and the full-wave rectification of the AC voltage is performed to provide a DC voltage. The DC voltage provided from the first rectifier circuit 10 is smoothed by the smoothing capacitors C1 and C2, and thus a DC input voltage Vin is generated. The DC input voltage Vin is provided to the inverter 20 and the inverter control circuit 30.

Next, the inverter 20 is described. The inverter 20 (INV) provides power for driving the LED 2. In the embodiment, the inverter 20 converts a DC voltage into an AC voltage. For example, the inverter 20 converts the DC voltage into the AC voltage of several tens of kilohertz.

This inverter 20 includes a first switching element Q1, a second switching element Q2 connected in series to the first switching element Q1, a driver transformer CT, an inductor L1, capacitors C5, C6, and C8, and resistors R5, R6, R7, and R8, and thermistors PTC1 and PTC2.

In the embodiment, the inverter 20 is a half-bridge self-excited inverter in which a series circuit including the first switching element Q1 and the second switching element Q2 that alternately perform their switching operations is connected to a DC power source. In the embodiment, the first switching element Q1 and the second switching element Q2 are bipolar transistors. It should be noted that the self-excited inverter according to the embodiment means an inverter with feedback control by the driver transformer and a plurality of the switching elements.

A collector of the first switching element Q1 is connected to a positive DC voltage output terminal of the first rectifier circuit 10 and the capacitor C5. An emitter of the first switching element Q1 is connected to a collector of the second switching element Q2 and a coil of the driver transformer CT via the resistor R5. In addition, a base of the first switching element Q1 is connected to the coil of the driver transformer CT via the resistor R7.

A collector of the second switching element Q2 is connected to an emitter of the first switching element Q1 and a coil of the driver transformer CT via the resistor R5. An emitter of the second switching element Q2 is connected to the negative DC voltage output terminal of the first rectifier circuit 10, a coil of the driver transformer CT, and the capacitors C6 and C8 via the resistor R6. In addition, a base of the second switching element Q2 is connected to the coil of the driver transformer CT via the resistor R8.

The driver transformer CT includes a wound coil comprising a primary winding (input winding) and a secondary winding (output winding).

The inductor L1 is a choke inductor, and has one terminal connected to the output side of the driver transformer CT and the other terminal connected to the input side of the second rectifier circuit 40. The capacitor C5 has one terminal connected to the positive DC voltage output terminal of the first rectifier circuit 10 and the other terminal connected to the input side of the second rectifier circuit 40. The capacitor C6 has one terminal connected to the negative DC voltage output terminal of the first rectifier circuit 10 and the other terminal connected to the input side of the second rectifier circuit 40. The capacitor C8 has one terminal connected to the negative DC voltage output terminal of the first rectifier circuit 10 and the other terminal connected to the other terminal of the inductor L1.

Thermistors PTC1 and PTC2 are a thermally sensitive element having a positive temperature characteristic. In other words, the thermistors PTC1 and PTC2 have a characteristic in which a resistance value increases when an ambient temperature increases. The thermistor PTC1 (first thermistor) is connected in parallel to the resistor R7 (first resistor). The thermistor PTC2 (second thermistor) is connected in parallel to the resistor R8 (second resistor).

With such a configuration, the inverter 20 is activated by applying a predetermined input voltage Vin to both ends of the series circuit including the first switching element Q1 and the second switching element Q2 (between the input ends of the inverter 20) and providing an activation control signal (trigger signal) from the inverter control circuit 30. More specifically, the first switching element Q1 and the second switching element Q2 are alternately turned on and off due to self-oscillation based on the induction of the driver transformer CT, and thus a secondary AC voltage is induced by the series resonance between the inductor L1 and the capacitor C8. Then, this voltage is provided to the second rectifier circuit 40.

Next, the inverter control circuit 30 for controlling the inverter 20 is described. The inverter control circuit 30 (TRG) is configured to control the operation of the inverter 20. In the embodiment, the inverter control circuit 30 activates and maintains the inverter 20.

The inverter control circuit 30 includes resistors R1, R2, and R3, a capacitor C3 connected in series to the resistor R1, and a trigger diode TD connected to the connection point between the resistor R1 and the capacitor C3.

The resistor R1 has one terminal connected to the positive DC voltage output terminal of the first rectifier circuit 10 via a resistor R2, and the other terminal connected to the negative DC voltage output terminal of the first rectifier circuit 10 via the capacitor C3. The capacitor C3 is a capacitor for controlling the conduction of the trigger diode TD, and has a high-potential terminal connected to the resistor R1 and a low-potential terminal connected to the negative DC voltage output terminal of the first rectifier circuit 10. It should be noted that, in the inverter control circuit 30, the resistor R1 and the capacitor C3 make up a time constant circuit. The resistor R3 is connected in parallel to the capacitor C3.

The trigger diode TD is a trigger element comprising a diode, and conducts current when the applied voltage exceeds a predetermined voltage (breakover voltage). In the embodiment, the trigger diode TD conducts current when the voltage stored in the capacitor C3 exceeds the breakover voltage. The trigger diode TD is connected to the base of the second switching element Q2 which is a control terminal of the inverter 20, and activates the inverter 20 by causing the trigger diode TD to conduct current.

In other words, the current begins to flow into the inverter 20 only after the second switching element Q2 is turned on by the inverter control circuit 30. In the case where voltage is excited in the secondary coil of the driver transformer CT by load current flowing when the second switching element Q2 is on, the second switching element Q2 is turned off and the first switching element Q1 is turned on. In the case where voltage is excited in the secondary coil of the driver transformer CT by load current flowing when the first switching element Q1 is on, the first switching element Q1 is turned off and the second switching element Q2 is turned on. With this, a constant operation begins where the first switching element Q1 and the second switching element Q2 are alternately turned on and off.

It should be noted that a DIAC with a breakover voltage ranging from 28 V to 36 V can be used as the trigger diode TD for example.

As described above, the inverter control circuit 30 is intended to activate the inverter 20, and includes: a circuit which adjusts voltage applied to both ends of the capacitor C3 with a distribution ratio of the resistors R1, R2, and R3; and the trigger diode TD in which the voltage value of the capacitor C3 exceeds the breakover voltage. Upon receiving the trigger signal from the inverter control circuit 30, the inverter 20 begins to self-oscillate.

The inverter control circuit 30 according to the embodiment includes the resistor R2 connected in series to the resistor R1, and a diode D1 connected in parallel to the resistor R1. The diode D1 is a rectifier diode. An anode of the diode D1 is connected to the connection point between the resistor R1 and the capacitor C3, and to the trigger diode TD. A cathode of the diode D1 is connected to the connection point between the resistor R1 and the resistor R2, the connection point between the first switching element Q1 (the emitter) and the second switching element Q2 (the collector) in the inverter 20, and the capacitor C4. It should be noted that the capacitor C4 has a high potential terminal connected to the positive DC voltage output terminal of the first rectifier circuit 10 and the collector of the first switching element Q1, and a low potential terminal connected to the cathode of the diode D1. The capacitor C4 is a snubber capacitor, and is appropriately used for reducing the simultaneous ON of the switching element Q1 and the switching element Q2.

Next, the second rectifier circuit 40 is described. Similar to the first rectifier circuit 10, the second rectifier circuit 40 (DB2) is a full-wave bridge rectifier circuit comprising four diodes. Two terminals on the input side of the second rectifier circuit 40 are connected to respective two terminals on the output side of the inverter 20. With respect to two terminals on the output side of the second rectifier circuit 40, a high potential terminal is connected to an anode of the LED 2 via the output terminal P3 and a low potential terminal is connected to a cathode of the LED 2 via the output terminal P4.

The second rectifier circuit 40 receives an AC voltage from the inverter 20, and a full-wave rectification of the AC voltage is performed to provide the resulting voltage to the LED 2.

It should be noted that the second rectifier circuit 40 can be provided with a combination of two semiconductor components each having two series-connected Schottky diodes.

Thus, the drive circuit 1 according to the embodiment has a configuration as described above.

Moreover, in the embodiment, there is a single LED 2, but there may be a plurality of the LED 2. In this case, the plurality of the LED 2 may be connected in series, in parallel, or in series-parallel combination.

(Circuit Operation)

Next, an operation of the drive circuit 1 according to the embodiment will be described.

For example, when a user turns on the wall switch to light the LED 2, AC power is supplied to the input terminals P1 and P2, and DC input voltage Vin smoothed by the first rectifier circuit 10 is generated. The input voltage Vin is applied between the input ends of the inverter 20 and between the input ends of the inverter control circuit 30.

With this, the inverter control circuit 30 and the inverter 20 are activated. In other words, the capacitor C3 in the inverter control circuit 30 is charged by applying the input voltage Vin to the inverter control circuit 30, and the trigger diode TD breaks over. Consequently, the trigger diode TD conducts current, and the trigger signal (trigger pulse) is provided to the base of the second switching element Q2 in the inverter 20, thereby turning on the second switching element Q2.

When the second switching element Q2 is turned on by the trigger signal, the inverter 20 is activated. Then, the first switching element Q1 and the second switching element Q2 are alternately turned on and off due to the self-oscillation based on the induction of the driver transformer CT, and thus the secondary AC voltage is induced. In this manner, the AC voltage generated by enhancing the secondary AC voltage by the series resonance between the inductor L1 and the capacitor C8 is provided to the second rectifier circuit 40. Then, the full-wave rectification of the AC voltage is performed by the second rectifier circuit 40, and a predetermined DC voltage (forward voltage VF) is provided to the LED 2 via the output terminals P3 and P4. Accordingly, the LED 2 is lighted on a desired level of illumination.

When a user turns off the wall switch to turn off the LED 2, the LED 2 is turned off because AC power supply to the input terminals P1 and P2 is interrupted.

Next, the operation of the drive circuit 1 when a temperature changes will be described.

The thermistors PTC1 and PTC 2 have characteristics that when an ambient temperature is lower than a threshold, the thermistors PTC1 and PTC2 have a predetermined resistance value, and that when an ambient temperature exceeds the threshold, the resistance value becomes infinite.

Therefore, at the time of normal lighting (when an ambient temperature is lower than the threshold), a base resistance value of the first switching element Q1 is a combined resistance value of the resistor R7 and the thermistor PTC1 connected in parallel. Meanwhile, when an ambient temperature increases to exceed the threshold, a resistance value of the thermistor PTC1 becomes infinite. Therefore, a base resistance value of the first switching element Q1 is a resistance value of the resistor R7. In other words, when an ambient temperature increases, base resistance of the first switching element Q1 increases.

Therefore, at the time of normal lighting, a base resistance value of the second switching element Q2 is a combined resistance value of the resistor R8 and the thermistor PTC2 connected in parallel. Meanwhile, when an ambient temperature increases to exceed the threshold, a resistance value of the thermistor PTC2 becomes infinite. Therefore, a base resistance value of the second switching element Q2 is a resistance value of the resistor R8. In other words, when an ambient temperature increases, base resistance of the first switching element Q2 increases.

As described above, since the base resistance of the first switching element Q1 and the second switching element Q2 increase, power supplied to the LED 2 by the inverter 20 decreases. Specifically, the current flowing through the LED 2 decreases. Accordingly, the heat generation of the LED 2 decreases.

As described above, the drive circuit 1 according to the embodiment can reduce the temperature of the LED 2 by reducing the heat generation of the LED 2 when an ambient temperature increases. Therefore, the drive circuit 1 can reduce the degradation of the LED 2.

As described above, the drive circuit 1 according to the embodiment is a drive circuit for turning on the LED 2, and includes a self-excited inverter 20 which supplies power to the LED 2. The self-excited inverter 20 includes the thermistors PTC1 and PTC2, and, depending on the temperature dependency of the thermistors PTC1 and PTC2, supplies the first power value to the LED 2 when the temperature is the first temperature, and supplies the second power value lower than the first power value to the LED 2 when the temperature is the second temperature higher than the first temperature. With this, the drive circuit 1 can reduce a rise in temperature of the LED 2.

It should be noted that the second power value may be smaller than the third power value to be supplied to the LED 2 by a circuit which is not provided with the thermistors PTC1 and PTC2 and supplies the first power value to the LED 2 when the temperature is the first temperature. In other words, the second power value may be equal to the first power value, and may be greater than the first power value.

For example, as a comparison example, consider a circuit in which the thermistors PTC1 and PTC2 are not included and the power value which is the same as that of the inverter 20 is supplied to the LED 2 at the time of normal lighting (when the temperature is the first temperature). Specifically, the circuit in the comparison example is a circuit obtained by removing the thermistors PTC1 and PTC2 from the inverter 20 shown in FIG. 1 and adjusting circuit parameters each having a power value supplied to the LED 2 at the time of normal lighting to be equal to that of the inverter 20. The adjustment of the power value can be realized by changing the resistance value of the resistors R7 and R8. In other words, the circuit in the comparison example has the same configuration as that of the inverter 20 except that the thermistors are not provided and the circuit parameter is adjusted.

Also in the circuit in the comparison example, depending on the temperature dependency of the circuit, the power value to be supplied to the LED 2 caused by a change in temperature changes. For example, in the circuit in the comparison example, when the temperature increases and the power value to be supplied to the LED increases, the inverter 20 may be configured such that an increase in power value caused by a rise in temperature is reduced using the thermistors. With this, the heat generation of the LED 2 can decrease compared with the case where the thermistors are not used. A degree of reduction in the heat generation can be adjusted by changing the resistance values of the resistors (resistors R7 and R8) connected in parallel to the thermistors.

It should be noted that the drive circuit 1 according to the embodiment is effective when the drive circuit 1 is used in an environment in which an ambient temperature of the drive circuit 1 is likely to increase. Specifically, when the light emitting unit (LED 2) and the drive circuit 1 are disposed adjacent to each other, or when the light emitting unit and the drive circuit 1 are sealed, the above configuration is effective.

Moreover, in the embodiment, a half-bridge self-excited inverter is used as the inverter 20. As described above, a drive circuit can be provided at a low cost by using the half-bridge self-excited inverter.

A drive circuit which can reduce the ambient temperature at a low cost can be provided using a low-priced thermistor for the half-bridge self-excited inverter.

(Modification)

It should be noted that the configuration shown in FIG. 1 is mere example, and any configuration is acceptable as long as it uses thermistors for a self-excited inverter.

Figure 2:
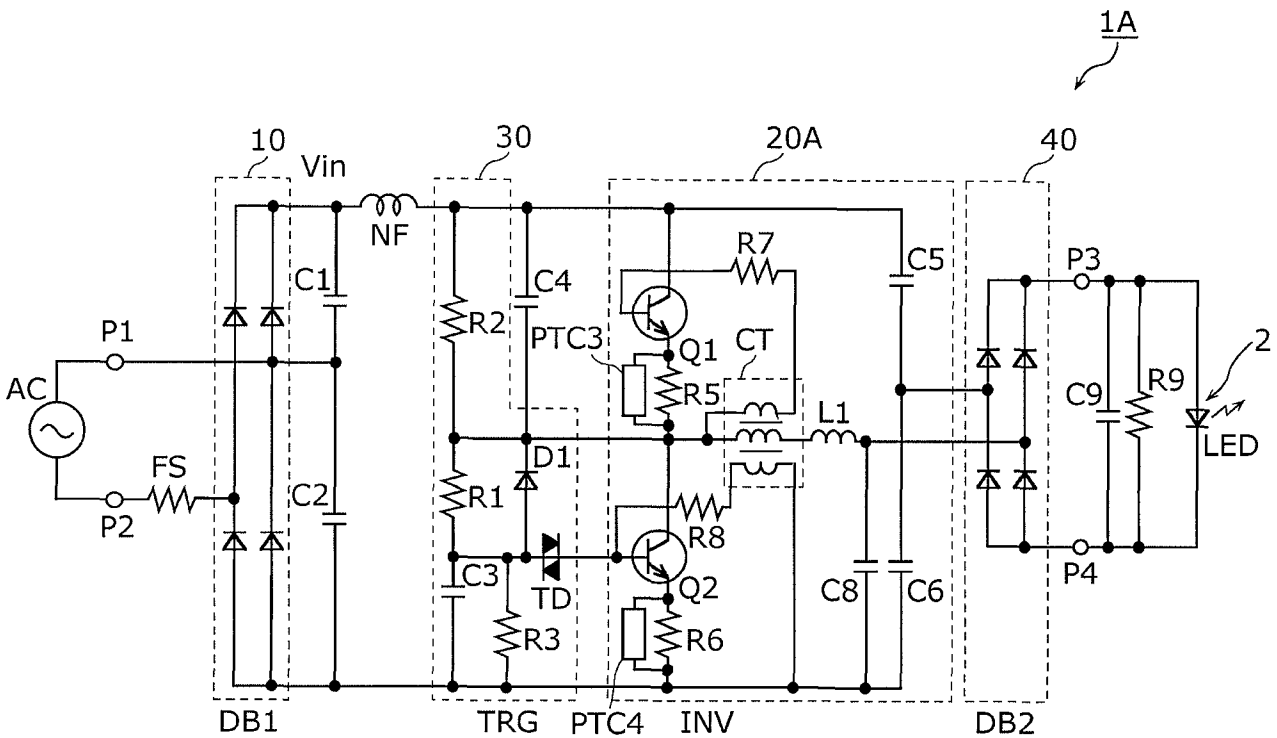
[FIG. 2]

FIG. 2 is a diagram showing a configuration of a drive circuit 1A according a modification of the embodiment. Compared between the drive circuit 1A shown in FIG. 2 and the drive circuit 1 shown in FIG. 1, the configuration of the inverter 20A is different from that of the inverter 20. Specifically, the inverter 20A includes a thermistor PTC3 and a thermistor PTC4 instead of the thermistors PTC1 and PTC2.

Thermistors PTC3 and PTC4 are each a thermally sensitive element having a positive temperature characteristic. The thermistor PTC3 (first thermistor) is connected in parallel to the resistor R5 (first resistor). The thermistor PTC4 (second thermistor) is connected in parallel to the resistor R6 (second resistor).

Accordingly, when an ambient temperature increases, the emitter resistance of the first switching element Q1 and the second switching element Q2 increases. With this, as similarly to the configuration shown in FIG. 1, when an ambient temperature increases, power supplied to the LED 2 by the inverter 20A decreases.

Although in the above description the inverter 20 includes the thermistors PTC1 and PTC2, the inverter 20 may include one of the thermistors PTC1 and PTC2. Similarly, the inverter 20A may include one of the thermistors PTC3 and PTC4.

Moreover, the inverter 20 or the inverter 20A may include all of the thermistors PTC1 to PTC4, or may include part of the thermistors PTC1 to PTC4.

Moreover, although the above description refers to an example of the case where a half-bridge self-excited inverter is used as the self-excited inverter, a self-excited inverter other than the half-bridge self-excited inverter may be used.

Moreover, although the above description describes that a thermistor has a characteristic in which the resistance value greatly changes at a threshold, the thermistor may have a characteristic in which the resistance value lineally changes according to the ambient temperature.

Although the above description describes an example of the case where a thermistor having a positive temperature characteristic is used, depending on the circuit configuration, the same effect as that of the thermistor having a negative temperature characteristic can be obtained.

(Illumination Light Source)

Figure 3:
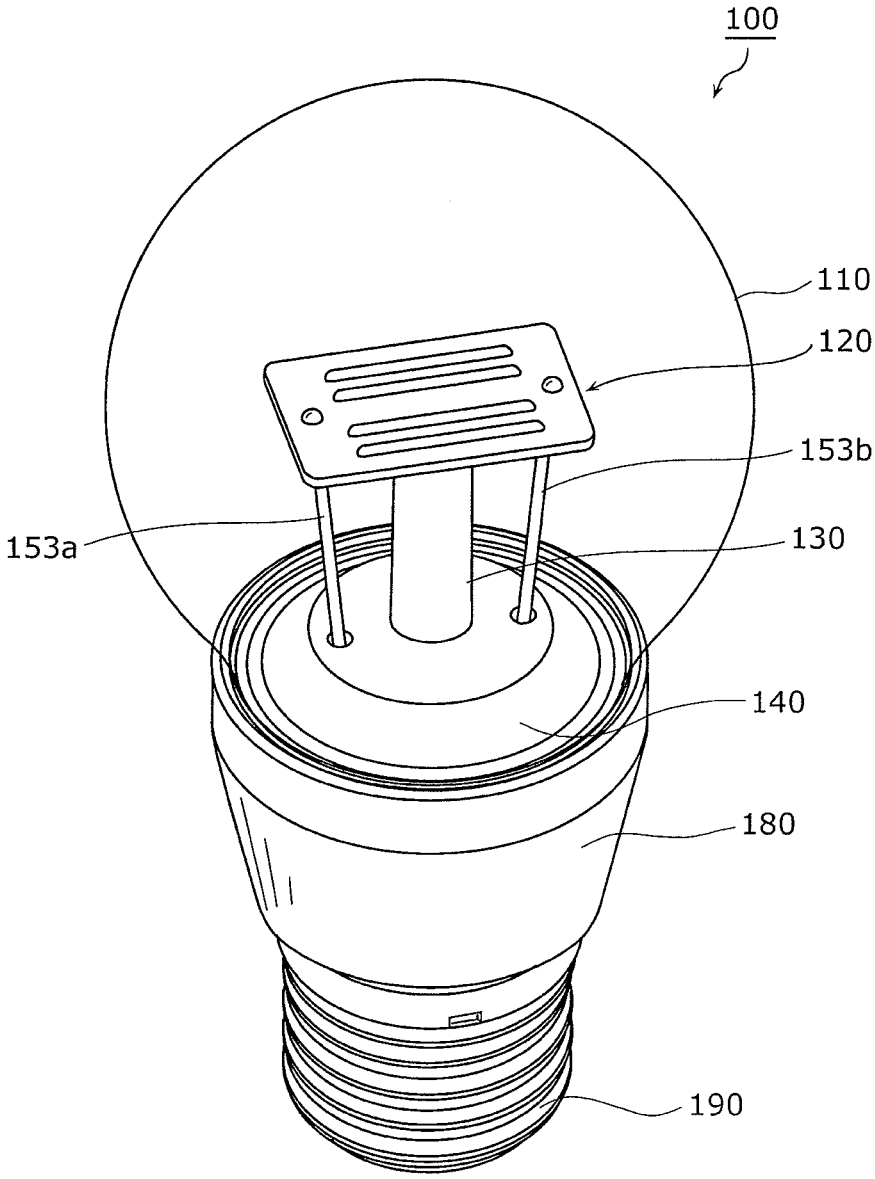
[FIG. 3]

Next, an example of the application for the drive circuit 1 and the drive circuit 1A will be described. FIG. 3 is an outer perspective view of a light bulb-shaped lamp 100 which is an illumination light source (LED light source) according to the embodiment.

In combination with the LED lighted by the drive circuits 1 and 1A, the drive circuits 1 and 1A according to the embodiment can be used as an LED light source. It should be noted that the LED light source according to the embodiment refers to a device having an LED to be lighted by a given drive circuit. Exemplary LED light sources include not only the device that combines the LED with the drive circuit, but also various lighting apparatuses such as a lighting apparatus which substitutes for the conventional light bulb-shaped fluorescent light and a lighting apparatus which substitutes for a halogen light bulb.

As shown in FIG. 3, the light bulb-shaped lamp 100 according to the embodiment is a light bulb-shaped lamp which substitutes for a light bulb-shaped fluorescent light or an incandescent light bulb, and includes a globe 110, an LED module 120 which is a light source, a support pole 130, a support member 140, an outer case 180, and a base 190.

It should be noted that an envelope of the light bulb-shaped lamp 100 is configured of the globe 110, the outer case 180, and the base 190.

The globe 110 is a light-transmissive cover for bringing out the light emitted from the LED module 120 to the outside of the lamp, and substantially has a semispherical shape. The globe 110 according to the embodiment is a glass bulb (clear bulb) made of silica glass which is transparent to visible light. Accordingly, the LED module 120 housed in the globe 110 can be viewed from outside of the globe 110.

The LED module 120 is covered by the globe 110. With this structure, the light of the LED module 120 which is incident on the inner surface of the globe 110 is brought out to the outside of the globe 110 by passing through the globe 110. In the embodiment, the globe 110 is configured to house the LED module 120.

The globe 110 has a shape with one end closed in a spherical shape, and the other end has an opening part. More specifically, the shape of the globe 110 is that a part of hollow sphere is narrowed down while extending away from the center of the sphere, and the opening part is provided at a position which is away from the center of the sphere. For the globe 110 having such a shape, a glass bulb having the same shape as a light bulb-shaped fluorescent light or an incandescent light bulb can be used. For example, A-type, G-type, E-type, or other type of glass bulb can be used as the globe 110.

The opening part of the globe 110 is provided on the surface of the support member 140. In this condition, the globe 110 is fixed by applying an adhesive such as a silicone resin between the support member 140 and the outer case 180.

It should be noted that the globe 110 need not be transparent to visible light, and may have a light-diffusing function. For example, a creamy white light-diffusing film can be formed by applying, on the entire inner surface or outer surface of the globe 110, a resin, white pigment, or the like, which contain a light-diffusing material such as silica, calcium carbonate, or the like. In this manner, with the light-diffusing function of the globe 110, the light entering the globe 110 from the LED module 120 can be diffused, thereby allowing a light distribution angle of the lamp to be increased.

The shape of the globe 110 is not limited to Type A or others, but may also be a spheroid or an oblate sphere. The material of the globe 110 is not limited to a glass material, but may also be a resin material such as acrylic (PMMA) or polycarbonate (PC), or others.

The LED module 120 is a light-emitting module which includes a light-emitting element (LED2), and emits a light of a predetermined color (wavelength) such as white, or the like. The LED module 120 is held in midair in the globe 110 by the support pole 130, and emits light using power supplied from the drive circuit 1 or 1A via lead wires 153*a* and 153*b*.

The support pole 130 is an elongated-shaped member provided extending toward the inside of the globe 110 from the vicinity of the opening part of the globe 110. The support pole 130 is served as a member which supports the LED module 120, and has one end attached to the LED module 120. The support pole 130 has the other end attached to the support member 140.

The support member 140 is a support pad which supports the support pole 130.

The outer case 180 is an envelope member. Moreover, the drive circuit 1 or 1A is disposed in the outer case 180.

The base 190 is a power receiving part which receives, from outside of the lamp, power for causing the LED module 120 (LED2) to emit light. The base 190 is, for example, attached to a socket of lighting equipment. Accordingly, when causing the light bulb-shaped lamp 100 to light up, the base 190 can receive power from the socket of the lighting equipment. For example, AC power is supplied to the base 190 from the utility 100V utility AC power source. The base 190 according to the embodiment receives the AC power through two contact points, and the power received by the base 190 is provided to the drive circuit 1 or 1A. The base 190 is not limited to a particular type, but a threaded Edison-type (E-type) base is used in the embodiment. Examples of the base 190 include E26-type, E17-type, E16-type, or other type of base.

It should be noted that the light bulb-shaped LED lamp is used as the exemplary lighting light source, but the drive circuit 1 or 1A can be applied to another lighting light source having a different shape such as a straight tube-shaped LED lamp or the like.

(Lighting Apparatus)

Figure 4:
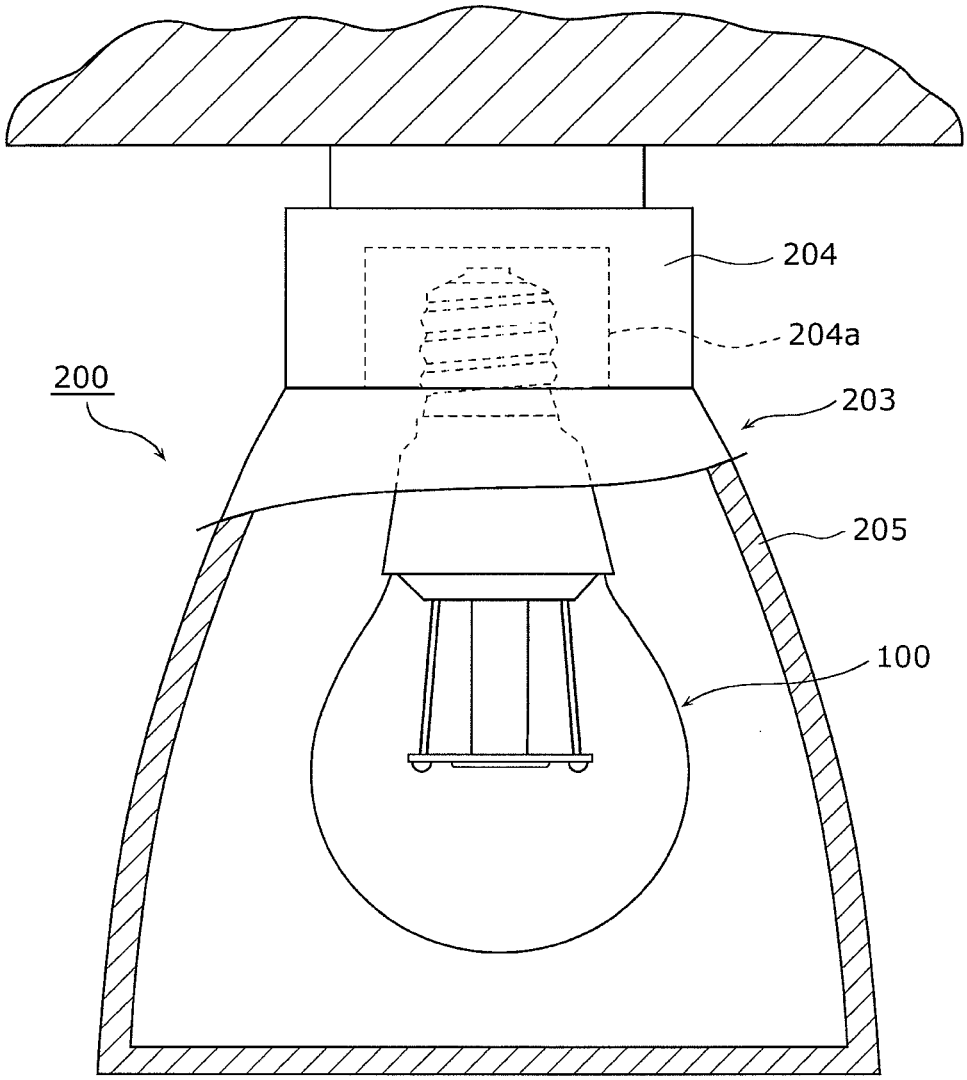
[FIG. 4]

The present invention can be implemented not only as the lighting light source (light bulb-shaped lamp 100), but also as a lighting apparatus including the lighting light source. The following describes a lighting apparatus 200 according to the embodiment with reference to FIG. 4. FIG. 4 is a schematic cross-sectional view of the lighting apparatus 200 according to the embodiment of the present invention.

As shown in FIG. 4, the lighting apparatus 200 according to the embodiment is installed on the ceiling of a room for example, and includes the light bulb-shaped lamp 100 according to the previously-described embodiment and a light-up device 203.

The light-up device 203 is a device for lighting up and putting out the light bulb-shaped lamp 100, and includes a device body 204 which is attached to the ceiling, and a light-transmissive lamp cover 205 which covers the light bulb-shaped lamp 100.

The device body 204 includes a socket 204*a*. The base 190 of the light bulb-shaped lamp 100 is screwed into the socket 204*a*. Power is supplied to the light bulb-shaped lamp 100 via the socket 204*a*.

It should be noted that the exemplary drive circuit 1 or 1A is included in the light bulb-shaped lamp 100, but the drive circuit 1 or 1A may be included in the light-up device 203 (device body 204).

Moreover, the drive circuit 1 or 1A may include at least the inverter 20 or the inverter 20A. For example, the second rectifier circuit 40 may be included in the LED module 120. Moreover, when the drive circuit 1 or 1A is included in the light-up device 203, part of the configuration shown in FIG. 1 or FIG. 2 may be included in the illumination light source (the light bulb-shaped lamp 100). Conversely, when the drive circuit 1 or 1A is included in the illumination light source, part of the configuration shown in FIG. 1 or FIG. 2 may be included in the light-up device 203.

A drive circuit, a lighting light source, and a lighting apparatus according to the embodiment of the present invention have been described, but the present invention is not limited to the above-described embodiment.

For example, although a bipolar transistor is used in the above description, it is possible to use other types of transistors such as a MOS transistor.

Furthermore, although an LED is given as an example of a light-emitting element in the foregoing embodiment, it is acceptable to use other solid-state light-emitting elements such as semiconductor light-emitting elements such as a semiconductor laser, or electroluminescence (EL) elements such as organic EL or non-organic EL.

Furthermore, all the above-mentioned numerical values are given to illustrate the present invention, but the present invention is not limited to these numerical values. Furthermore, all the above-mentioned materials for the respective constituent elements are given to illustrate the present invention, but the present invention is not limited to these materials. Furthermore, a connection relationship between the constituent elements is given to illustrate the present invention, but the connection relationship to accomplish the function of the present invention is not limited to this.

Furthermore, the exemplary circuit configurations are shown in the foregoing circuit diagrams, but the present invention is not limited to these circuit configurations. In other words, the present invention includes circuits for accomplishing the distinct function of the present invention in the similar manner to the circuit configurations as described above. For example, the present invention includes circuits in each of which a given element is connected in series or in parallel to another element such as a switching element (transistor), a resistive element, or a capacitive element, to the extent that the function similar to that of the circuit configurations can be accomplished. In other words, the term "connected" used in the embodiment is not limited to the case where two terminals (nodes) are connected directly to each other, and includes the case where the two terminals (nodes) are connected via an element to the extent that the similar function can be accomplished.

A drive circuit, a lighting light source, and a lighting apparatus according to one or more aspects have been described based on the embodiment, but the present invention is not limited to the above-described embodiment. Various modifications to the embodiment that can be conceived by those skilled in the art as well as forms configured by combining constituent elements in different embodiments which are within the teachings of the present invention may be included in the scope of the one or more aspects.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

The invention claimed is:

1. A drive circuit for turning on a light-emitting element, the drive circuit comprising:

a self-excited inverter which supplies power to the light-emitting element, wherein the self-excited inverter includes a thermistor, and depending on temperature dependency of the thermistor, supplies a first power value to the light-emitting element when a temperature is a first temperature, and a second power value to the light-emitting element when a temperature is a second temperature higher than the first temperature, the self-excited inverter is a half-bridge self-excited inverter, the thermistor has a positive temperature characteristic, the self-excited inverter further includes:

a first switching element and a second switching element which are connected in series and alternately perform switching operations;

a first resistor connected to a base of the first switching element; and a second resistor connected to a base of the second switching element, the thermistor includes a first thermistor and a second thermistor, the first thermistor is connected in parallel to the first resistor, and the second thermistor is connected in parallel to the second resistor.

2. A drive circuit for turning on a light-emitting element, the drive circuit comprising:

a self-excited inverter which supplies power to the light-emitting element, wherein the self-excited inverter includes a thermistor, and depending on temperature dependency of the thermistor, supplies a first power value to the light-emitting element when a temperature is a first temperature, and a second power value to the light-emitting element when a temperature is a second temperature higher than the first temperature, the self-excited inverter is a half-bridge self-excited inverter, the thermistor has a positive temperature characteristic, the self-excited inverter further includes:

a first switching element and a second switching element which are connected in series and alternately perform switching operations;

a first resistor connected to an emitter of the first switching element; and a second resistor connected to an emitter of the second switching element, the thermistor includes a first thermistor and a second thermistor, the first thermistor is connected in parallel to the first resistor, and the second thermistor is connected in parallel to the second resistor.

3. An illumination light source comprising:

the drive circuit according to claim 1; and a light-emitting element which is turned on by the drive circuit.

4. A lighting apparatus comprising:

the drive circuit according to claim 1; and a light-emitting element which is turned on by the drive circuit.

5. An illumination light source comprising:

the circuit according to claim 2; and a light-emitting element which is turned on by the drive circuit.

6. A lighting apparatus comprising:

the drive circuit according to claim 2; and a light-emitting element which is turned on by the drive circuit.

* * * * *